United States Patent [19]

Riecker

[11] 4,029,551

[45] June 14, 1977

[54] SUCTION ARRANGEMENT FOR WITHDRAWING CONTAMINATED GASES EMITTED FROM INCANDESCENT COKE PUSHED OUT FROM A COKING OVEN

[75] Inventor: Johann Georg Riecker, Ratingen, Germany

[73] Assignee: Hartung, Kuhn & Co. Maschinenfabrik GmbH, Duesseldorf, Germany

[22] Filed: Nov. 24, 1975

[21] Appl. No.: 634,405

[30] Foreign Application Priority Data

Nov. 25, 1974 Germany ..... 2455737

[52] U.S. Cl. ..... 202/263

[51] Int. Cl.[2] ..... C10B 27/00

[58] Field of Search ..... 202/263, 262, 227

[56] References Cited

UNITED STATES PATENTS

| | | | |
|---|---|---|---|
| 3,716,457 | 2/1973 | Schon | 202/263 |
| 3,785,933 | 1/1974 | Edgar et al. | 202/263 |
| 3,788,236 | 1/1974 | Edgar et al. | 202/263 X |
| 3,801,473 | 4/1974 | Schoen et al. | 202/263 |

*Primary Examiner*—Morris O. Wolk
*Assistant Examiner*—Arnold Turk
*Attorney, Agent, or Firm*—Michael J. Striker

[57] ABSTRACT

The coking installation has a row of coke discharge openings, a coke guide car mounted for travel along the row, a coke quenching car mounted for travel along the row and adapted to receive coke pushed out from the coke discharge openings through the coke guide car, and a suction arrangement for generating suction. A hood structure is mounted for travel along the row of coke discharge openings. The hood is connectable to the suction arrangement and movable into a position extending over the whole breadth but only a fraction of the length of the quenching car. Wind shields are provided on opposite ends of the hood in the region of the lower end of the hood. The wind shields extend horizontally in opposite respective travel directions of the hood and each has a breadth corresponding to the breadth of the hood.

8 Claims, 5 Drawing Figures

SUCTION ARRANGEMENT FOR WITHDRAWING CONTAMINATED GASES EMITTED FROM INCANDESCENT COKE PUSHED OUT FROM A COKING OVEN

BACKGROUND OF THE INVENTION

The invention relates to arrangements for sucking off and cleansing a contaminated gas-air mixture rising up from incandescent coke pushed out of a coking oven chamber through a guide car and into a quenching car. More particularly, the invention relates to an arrangement in which use is made of a hood connectable to a suck-off and cleansing arrangement, with the hood engaging over the quenching car over the full breadth but only part of the length of the quenching car, and with the hood structure, the coke guide car and the quenching car all being mounted for travel along the coking oven battery.

The collection and suck-up action of the hood of such an arrangement can be detrimentally influenced by strong wind. For this reason, such hoods are connected to suck-up arrangements capable of affording an extremely high suction power. Despite the use of such very high suction powers, the detrimental influence of the wind cannot be completely overcome. Experimentation has indicated that the collection and suck-up efficiency of such hoods can decrease by as much as 50% as a result of the action of wind having speeds above 16 meters per second.

An attempt has been made to solve this problem by arranging a plurality of transverse bulkheads inside the quenching car and/or inside the hood structure so as to at least partially block or impede the wind. That expedient adds to the cost of the structures and interferes with the filling of the quenching car. Also, the transverse bulkheads are subject to considerable wear and must be frequently replaced. Most importantly, the amount of exposed surface area between the bottom of the quenching car and the lower edge of the hood is still too great and permits the entrance of wind and air infiltration.

SUMMARY OF THE INVENTION

It is a general object of the invention to provide simple means, capable of incorporation into already existing coking installations, for excluding the influence of wind upon the collecting and suck-up action of an arrangement of the type in question, i.e., provided with a hood.

This object, and others which will become clearer below, can be met by providing the hood with wind shields at the lower ends of the transverse end walls of the hood, with the wind shields having the transverse breadth of the hood and extending horizontally in respective opposite directions of the travel of the hood along the coking oven battery.

Advantageously, the length of the hood and the lengths of its wind shields are so selected that the wind shields can simultaneously and substantially seal-tightly, cover over and close off both end walls of the quenching wagon travelling beneath the hood. In this way, when the coked coking mass is pushed out of an oven chamber of the coking oven battery, and the quenching car is in its starting position, one wind shield will extend at a small spacing beneath the lower edge of the associated transverse end of the hood to substantially seal or close off the interior space of the hood and of the quenching car from the ambient atmosphere. In the end position of the quenching car, during the coke pressing operation, the other wind shield, for example the wind shield which faces away from the locomotive for the quenching car, then closes off its associated transverse end of the hood in an analogous manner.

In order to produce the most complete possible sealing action between the quenching car and the hood, or between the quenching car and the wind shields associated with the hood, it is advantageous if the travel (transverse) profile of the lower edges of the narrow (transverse) ends of the hood, and likewise of its wind shields, match the contour of the roof and side walls of the locomotive for the quenching car, with just enough of a clearance being left to assure unhindered travel of the locomotive through the space beneath the hood.

A further improvement results when wind guides are provided on the two end (transverse) walls of the quenching car extending over the full breadth of these walls in opposite respective travel directions of the quenching car at a height slightly below the wind shields of the hood, with these wind guides having a travel (transverse) profile corresponding to that of the locomotive for the quenching car. Advantageously, the end (transverse) walls of the quenching car likewise have a travel profile matching that of the locomotive for the quenching car. In this way, the spacing of the starting and end positions of the quenching car relative to the hood during the coke pressing operation can be increased while still precluding the influence of wind. This is because the hood is sealed off at one of its short (transverse) ends during the entire coke pressing operation. The other short (transverse) end of the hood can be left open to the atmosphere, according to the principle of the five-walled box, because wind blowing into such a space is merely dammed and no appreciable exchange of air occurs as between the interior and the exterior of the space. At the end of the coke pressing operation, a part of the quenching car remains uncovered. Therefore, air can be sucked over the coke which has been pushed onto the quenching car, as a result of which uncombusted components, possibly gaseous components, of the coke can be combusted. Experiments have proved that this results in the avoidance of dust and gas emissions during the travel of the quenching car toward the quenching tower.

In coking installations where the parking space for travelling hoods and/or quenching cars is limited, the wind guides of the quenching car and/or the wind shields of the hood can be mounted swingable between their horizontal operative positions and vertical inoperative positions which consume less space. This swingability of the wind guides on the quenching car may also be of significance when the car reaches the quenching tower, specifically to avoid the pouring of quenching water onto the wind guides.

Preferably, the passage through which coke is pushed out of the coke oven chamber and into the quenching car is centered relative to the leading and trailing ends of the hood.

Advantageously, the hood and the coke guide car form parts of a single gantry structure which travels along the coking oven battery.

The inventive suck-off arrangement has the advantage, relative to conventional structures of this general type, that it can be of light construction. As a result, lesser loads are to be borne by the rails of the main track supporting the coke guide car and by the third rail for the gantry structure, this third rail being located along that side of the quenching car remote from the coking oven battery. This advantage is of particular importance for older batteries whose main track rails are usually capable of bearing only limited loads.

The good protection against the influence of wind and air penetration makes possible a decrease in the suction power required for a particular collection and suction action, or conversely makes for a greater collection and suction action for a given suction power. The reduction in the suction power needed to produce a particular suction action can be as great as 50%. If the arrangement is operated with a hitherto conventional suction power of for example more than 200,000 $m^3/h$, then the good sealing of the hood relative to the quenching car assures the containment of unusually large emission volumes without detrimental impact upon the environment and upon the healthiness of employees' working conditions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
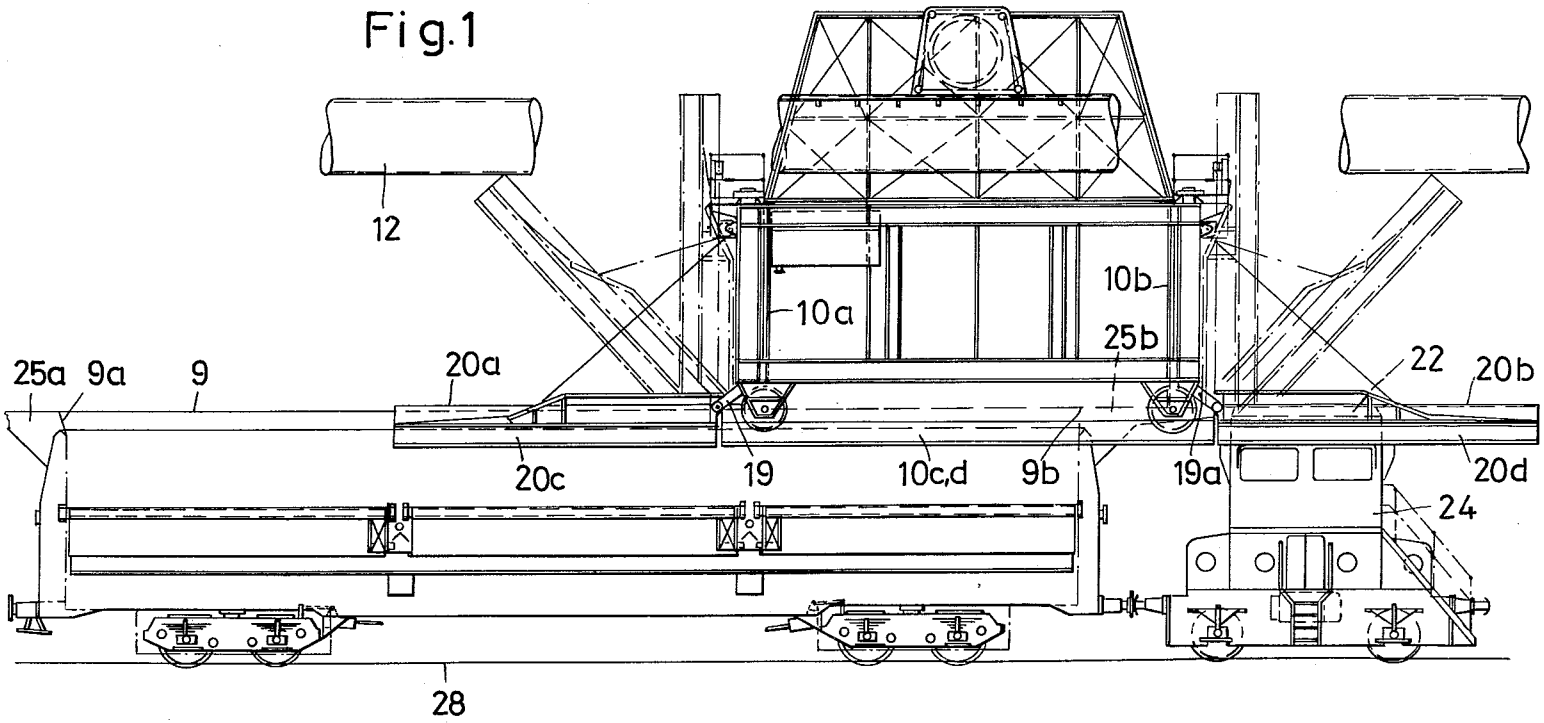
FIG. 1 is a schematic view of a coking installation.

The Figures depict a coking installation and parts of an arrangement for sucking off and cleaning contaminated gas-air mixtures. Incandescent coke is pushed from an oven chamber 6 of a horizontal chamber (vertical-flue) coking oven 7 through a coke guide car 8 into a quenching car 9. The contaminated gas-air mixture rising up from the coke in the quenching car 9 is sucked up into a hood 10. At its upper side, the hood 10 is provided with a telescope conduit 11 which is connectable to an opening in a stationary suck-off conduit 12 leading to a (non-illustrated) stationary suction and cleansing station.

Figure 2:
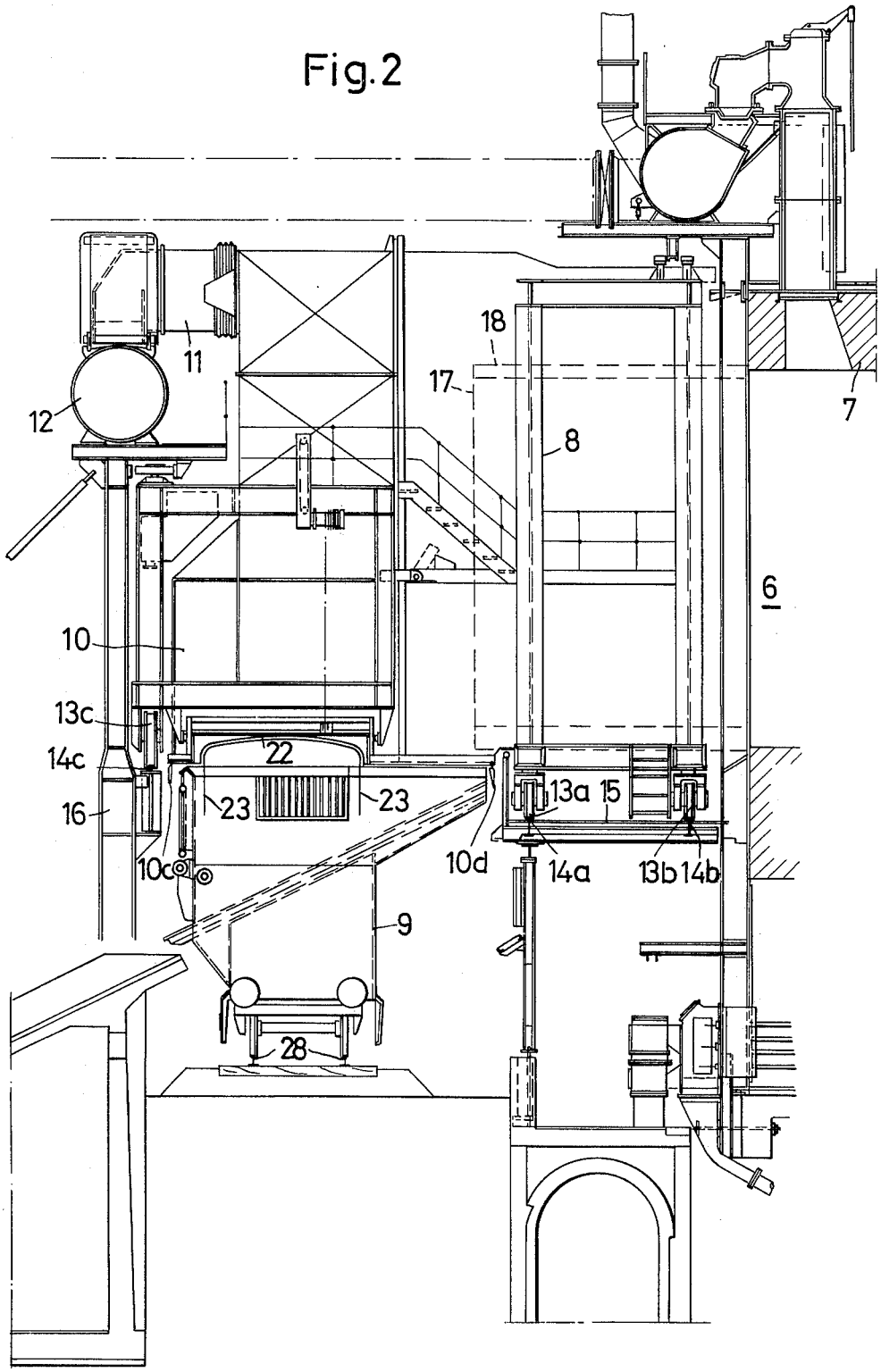
FIG. 2 is a partial transverse section and end view of the coking installation of FIG. 1.

As shown in FIG. 2, the hood 10 engages over the quenching car 9 over the entire breadth of the quenching car. The hood 10 is provided with chimney skirts **10*c*, 10*d* which run along the long sides of the quenching car 9** and extend downward slightly spaced from the long sides of the quenching car.

As can be seen in FIG. 1, the hood 10 extends over only a fraction of the total length of quenching car 9. Hood 10 is mounted on a gantry structure which also includes the guide car 8. The entire gantry structure can travel along the battery of coking ovens, along the coke discharge ends, by means of wheels **13*a*, 13*b* which ride on rails 14*a*, 14*b* of a main track 15 of the coking oven battery and by means of wheels 13*c* which ride on a rail 14*c*. Rail 14*c* is laid out across supports 16 (one shown in FIG. 2) located at that side of the quenching car track 28 remote from the coking oven battery. It should be repeated that the guide car 8 and the hood 10**, as well as the gantry structure which supports them, move along the coking oven battery as a unit, in the illustrated exemplary embodiment.

As viewed in FIG. 1, the hood 10 is of symmetrical construction, so that the (non-illustrated) discharge opening of the coking oven chamber, which will be in register with the discharge side 17 of the coke guide structure 18 of the guide car 8, will line up with the symmetry line of the hood 10.

Mounted on the lower edges of the short or narrow sides **10*a*, 10*b* of the hood structure 10 are left and right pairs of mounting brackets 19, 19*a*. Each pair of mounting brackets 19 or 19*a* is inclined downward in direction opposite to the associated direction of car travel. Pivotally mounted on brackets 19 is a wind shield structure 20*a*, and pivotally mounted on brackets 19*a* is a wind shield structure 20*b*. The wind shield structures 20*a*, 20*b*** are advantageously made of sheet metal. They are pivotable from (solid-line) horizontal operative positions to (dash-dot-line) vertical inoperative positions by means of a manually controllable cable drive, hydraulic positioning cylinders, or the like.

The sheet-metal wind shield structures **20*a*, 20*b* are designed in correspondence to the design of the lower side of the hood 10, i.e., wind shield structures 20*a*, 20*b* are provided with chimney skirts 20*c*, 20*d* corresponding to chimney skirts 10*c*, 10*d* of hood 10. Chimney skirts 20*c*, 20*d*, like skirts 10*c*, 10*d*, run along and engage (or else are just slightly spaced apart from) the long sides of quenching car 9. Likewise, the transverse configuration of the lower side of the wind protection structures 20*a*, 20*b*, i.e., the configuration as viewed in the direction of travel, corresponds to the configuration of the lower ends of the short or transverse sides 10*a*, 10*b* of hood structure 10, and furthermore are matched to the shape of the roof 22 and the side walls 23 of a quenching car locomotive 24**.

The longitudinal side walls and transverse end walls of the quenching car 9 extend up to such a height as to just clear the lower ends of the hood structure 10 and the wind shield structures **20*a*, 20*b*, to just assure unhindered travel of the quenching car 9 through these structures. Accordingly, the transverse end walls 9*a*, 9*b* have at their upper ends a configuration matched to the upper configuration of the quenching car locomotive 24**.

Projecting from the outer sides of transverse side walls **9*a*, 9*b* are wind guide structures 25*a*, 25*b*, preferably made of sheet metal. The wind guide structures 25*a*, 25*b* extend horizontally in opposite respective directions along the path of movement of the quenching car 9. The wind guide structures 25*a*, 25*b* extend over the full breadth of the quenching car 9. The transverse configuration of the upper ends of the wind guide structures 25*a*, 25*b* corresponds to the transverse configuration of the lower ends of the wind shield structures 20*a*, 20*b* and the transverse end walls 10*a*, 10*b* of the hood structure 10, again so as to leave a clearance just sufficient to assure unhindered travel of the quenching car 9** through the space beneath the hood structure and the wind shield structures.

Figure 4:
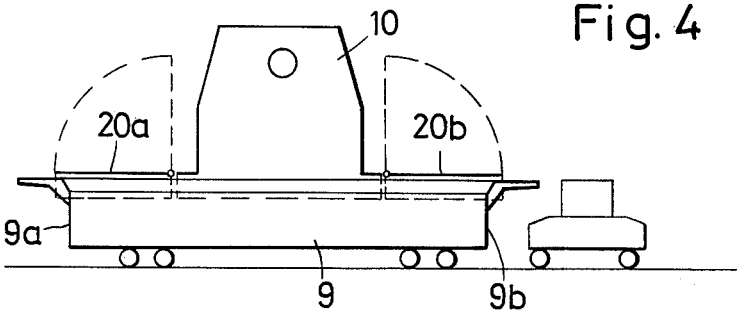

As can be seen in FIG. 4, the length of the hood 10 and the lengths of its associated wind shield structures **20*a*, 20*b* are such that when quenching car 9 is centered beneath this arrangement the hood and wind shields will extend over a distance greater than the distance between the facing inner sides of the transverse end walls 9*a*, 9*b* of quenching car 9**.

Figure 3:
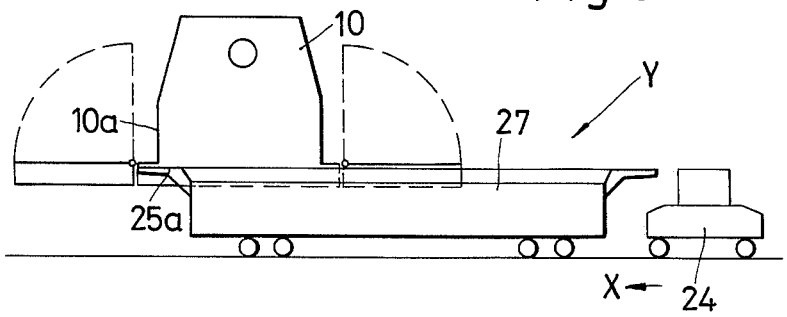
FIGS. 3, 4 and 5 show the relative starting, middle and end positions of the hood and quenching car during the coke pressing operation.
Figure 5:
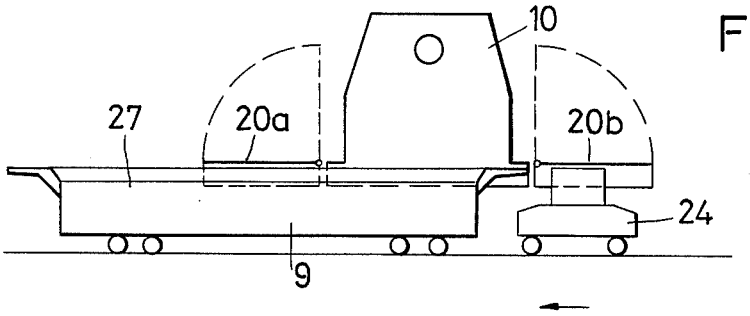

As can be seen in FIG. 3, this design of the hood and its wind shields is such that when the hood 10 is in its starting position and the wind guide 25*a* close off the interior of the hood and of the quenching car, leaving this interior space open to the outside only at one side, namely at 27. The volume of air blown by the wind in direction *y* into the opening 27 and then into the hood is either completely sucked up through the hood by the (non-illustrated) suck-off and cleansing arrangement or else partly dammed in the interior of the hood and quenching car. In this way, combustible components of the incandescent coke dumped onto the quenching car 9 will be combusted. As a result, as the quenching car 9 is moved further to the position of FIG. 5, with an opening 27 now being formed at the leading end of the quenching car, no appreciable amounts of dust or polluting gases will escape into the atmposphere from the incandescent coke lying on the inclined bottom of the quenching car. Accordingly, the chamber jointly formed by the hood and the quenching car is kept closed off in such a way that the hood and its wind shields, on the one hand, and the quenching car and its wind guides, on the other hand, form at at least one end of the quenching car a substantially seal-tight closure, with the chamber jointly formed by the hood and quenching car being completely closed off for a brief period corresponding to the illustration in FIG. 4.

The wind guide structures 25*a*, 25*b* can be pivotally secured to the transverse end walls of quenching car 9 in the same way that the wind shield structures 20*a*, 20*b* are pivotally mounted on the transverse ends of hood 10. In particular, it is advantageous if the wind guide structures 25*a*, 25*b* can be downwardly swung into a vertical position when the quenching car is in its parked position or beneath the quenching tower. The swinging of the wind guide structures can be performed by hand using a cable windlass or, preferably, by means of an hydraulically or electrically actuated positioning cylinder.

In the illustrated embodiment, the hood with its wind shields travels with the guide car. However, the invention also contemplates making the hood and wind shield structures movable independently of the movement of the guide car and quenching car, for example, by providing an independent gantry or guide rail arrangement for the hood and wind shield structures.

It will be understood that each of the elements described above, or two or more together, may also find a useful application in other types of constructions differing from the types described above.

While the invention has been illustrated and described as embodied in a hood structure movable on rails, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a coking installation having a row of coke discharge openings, a combination comprising a coke guide car mounted for travel along the row; a coke quenching car mounted for travel along the row and having a single recess adapted to receive coke pushed out from the coke discharge openings through the coke guide car; a suction arrangement for generating suction; a hood structure mounted for travel along the row of coke discharge openings and including opposite side walls having lower edges, the hood being connectable to the suction arrangement and movable into a position extending over the whole breadth but only a fraction of the length of the quenching car; wind shields provided on said opposite side walls of the hood in the region of the lower edges thereof, the wind shields extending horizontally outwardly from the hood in opposite respective travel directions of the hood and together with said hood having a combined length which is substantially equal to but slightly greater than the length of said quenching car, each of said wind shields having a breadth corresponding to the breadth of the hood; and wind guides provided on transverse end walls of the quenching car and having a breadth corresponding to the quenching car breadth, said wind guides being located slightly below said lower edges of said hood and of said wind shields and each extending horizontally outwardly from the quenching car in one of the opposite travel directions of said quenching car.

2. In an installation as defined in claim 1, wherein the wind shields are mounted for swinging movement between their horizontal operative positions and generally vertical inoperative positions.

3. In an installation as defined in claim 1, wherein a coking mass through-passage opening of the hood is located centered intermediate said side walls.

4. In an installation as defined in claim 1, wherein the hood and the coke guide car are both supported on a gantry structure mounted on rails for movement along the row of coke discharge openings.

5. In an installation as defined in claim 1, further including a locomotive for the quenching car, the profile of the lower edges of the side walls of the hood and also the transverse profile of the wind shields corresponding to the transverse profile of the upper end of the locomotive and of the wind guides on the quenching car, these lower and upper ends being spaced a distance permitting unhindered travel of the quenching car and locomotive through the space beneath the hood and wind shields.

6. In an installation as defined in claim 5, the profile of the upper ends of the transverse end walls of the quenching car matching the aforementioned transverse profiles of the aforementioned upper and lower ends.

7. In an installation as defined in claim 1, wherein the wind guides are mounted for swinging movement between their horizontal operative positions and generally vertical inoperative positions.

8. In an installation as defined in claim 7, wherein the wind shields are mounted for swinging movement between their horizontal operative positions and generally vertical inoperative positions.

* * * * *